US009914314B2

(12) United States Patent
Seng et al.

(10) Patent No.: US 9,914,314 B2
(45) Date of Patent: Mar. 13, 2018

(54) PRINTER

(71) Applicant: TOSHIBA TEC KABUSHIKI KAISHA, Shinagawa-ku, Tokyo (JP)

(72) Inventors: Ooi In Seng, Singapore (SG); Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/384,488

(22) Filed: Dec. 20, 2016

(65) Prior Publication Data

US 2017/0182811 A1 Jun. 29, 2017

(30) Foreign Application Priority Data

Dec. 25, 2015 (JP) ..... 2015-254688

(51) Int. Cl.

| | |
|---|---|
| ***B41J 11/04*** | (2006.01) |
| ***B41J 15/04*** | (2006.01) |
| ***B41J 2/32*** | (2006.01) |
| ***B41J 11/70*** | (2006.01) |
| ***B41J 29/38*** | (2006.01) |
| ***B41J 11/14*** | (2006.01) |

(52) U.S. Cl.

CPC ..... *B41J 15/042* (2013.01); *B41J 2/32* (2013.01); *B41J 11/04* (2013.01); *B41J 11/14* (2013.01); *B41J 11/703* (2013.01); *B41J 15/046* (2013.01); *B41J 29/38* (2013.01); *B41J 2202/31* (2013.01)

(58) Field of Classification Search

CPC . B41J 15/042; B41J 11/04; B41J 29/02; B41J 2202/31; B41J 3/60; B41J 11/0095

See application file for complete search history.

(56) References Cited

U.S. PATENT DOCUMENTS

| | | | | |
|---|---|---|---|---|
| 7,367,726 | B2 * | 5/2008 | Son | B41J 3/60 347/197 |
| 7,391,428 | B2 * | 6/2008 | Lee | B41J 2/32 347/197 |
| 7,828,290 | B2 | 11/2010 | Muratani | |
| 2005/0078996 | A1 * | 4/2005 | Lee | B41J 23/02 400/120.17 |
| 2006/0115311 | A1 * | 6/2006 | Son | B41J 3/60 400/120.17 |
| 2006/0263135 | A1 * | 11/2006 | Lee | B41J 25/304 400/120.16 |
| 2006/0290771 | A1 * | 12/2006 | Han | B41J 13/0045 347/220 |
| 2007/0036600 | A1 * | 2/2007 | Lee | B41J 13/0045 400/188 |
| 2015/0202895 | A1 * | 7/2015 | Nihashi | B41J 11/007 347/218 |

* cited by examiner

*Primary Examiner* — Huan Tran

(74) *Attorney, Agent, or Firm* — Amin, Turocy & Watson LLP

(57) ABSTRACT

In accordance with an embodiment, a printer comprises a housing section and a printer section. The housing section houses a roll-like image receiving medium. The printer section comprises a print head, a platen and a discharge section. The print head prints information on the image receiving medium fed from the housing section. The platen is arranged opposite to the print head and rotates around a rotating shaft. The discharge section discharges the image receiving medium passing through a space between the print head and the platen. The printer section rotates around the rotating shaft independent of the platen.

18 Claims, 6 Drawing Sheets

PRINTER

CROSS-REFERENCE TO RELATED APPLICATIONS

This application is based upon and claims the benefit of priority from Japanese Patent Application No. 2015-254688, filed Dec. 25, 2015, the entire contents of which are incorporated herein by reference.

FIELD

Embodiments described herein relate generally to a printer for printing information on an image receiving medium and methods associated therewith.

BACKGROUND

In recent years, printers are used in various fields. Starting from a printer used in an office, printers (hereinafter, receipt printers) for printing receipts used in various stores become popular. There are many restrictions on an arrangement position of the receipt printer used at a store counter, in this way, various kinds of demands for the receipt printer are made.

For example, a demand for a discharge position (discharge direction) of the receipt is made for the receipt printer. In a case of placing the receipt printer on the desk, the restriction on the discharge position of the receipt is comparatively small, for example, it is considered that the discharge position may be an upper part (receipt is discharged in a vertical direction) of a casing of the receipt printer. However, in a case of arranging the receipt printer under the desk or in a drawer, usability is poor if the discharge position is the upper part of the casing. Further, the cost becomes higher if a printer (discharge position) is designed according to a request from a user rather than one standard for all users.

DETAILED DESCRIPTION

In accordance with an embodiment, a printer comprises a housing section and a printer section. The housing section houses a roll-like image receiving medium. The printer section comprises a print head, a platen and a discharge section. The print head prints information on the image receiving medium fed from the housing section. The platen is arranged opposite to the print head and rotates around a rotating shaft. The discharge section discharges the image receiving medium passing through a space between the print head and the platen. The printer section rotates around the rotating shaft independent of the platen.

In accordance with another embodiment, a printing method involves rotating a printer section around a rotating shaft independent of a platen, the printer section comprising a print head; printing information on a roll-like image receiving medium; rotating the platen around a rotating shaft, the platen arranged opposite to the print head; and discharging the image receiving medium passing through a space between the print head and the platen.

Hereinafter, embodiments are described with reference to the accompanying drawings.

Figure 1:
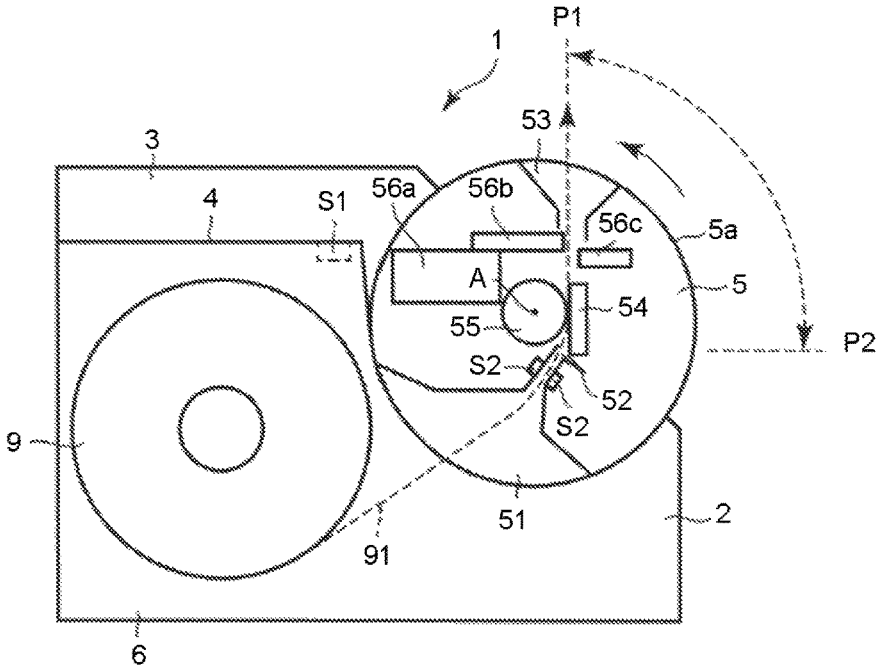
FIG. 1 is a sectional view exemplifying schematic configurations of a printer according to an embodiment from a lateral side and is a diagram illustrating an example of a printer section of which a discharge section stops at a first position (for example, vertical direction discharge position)
Figure 2:
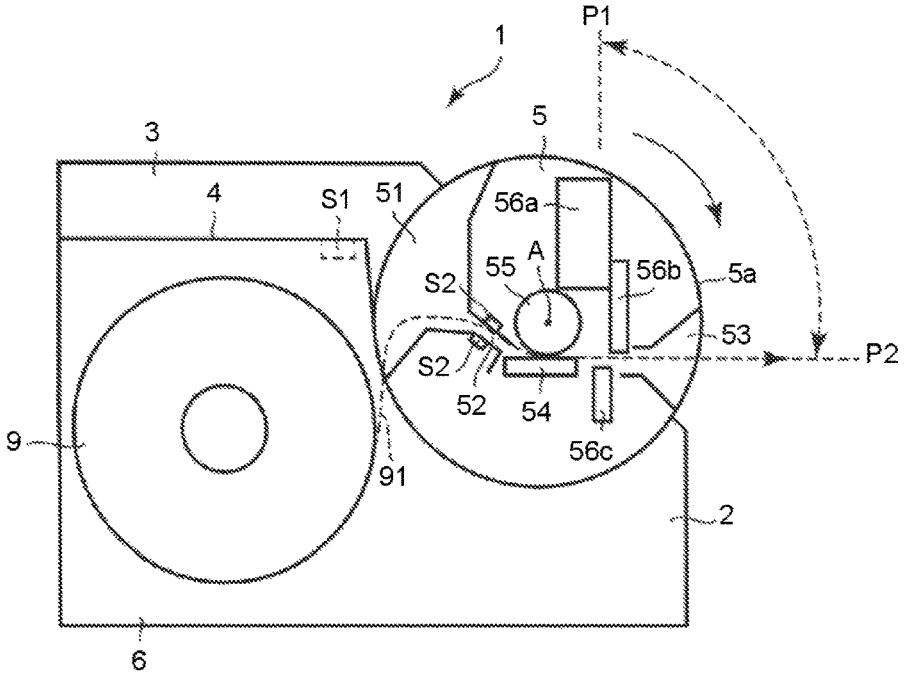
FIG. 2 is a sectional view exemplifying schematic configurations of the printer according to the embodiment from the lateral side and is a diagram illustrating an example of the printer section of which the discharge section stops at a second position (for example, horizontal direction discharge position)
Figure 3:
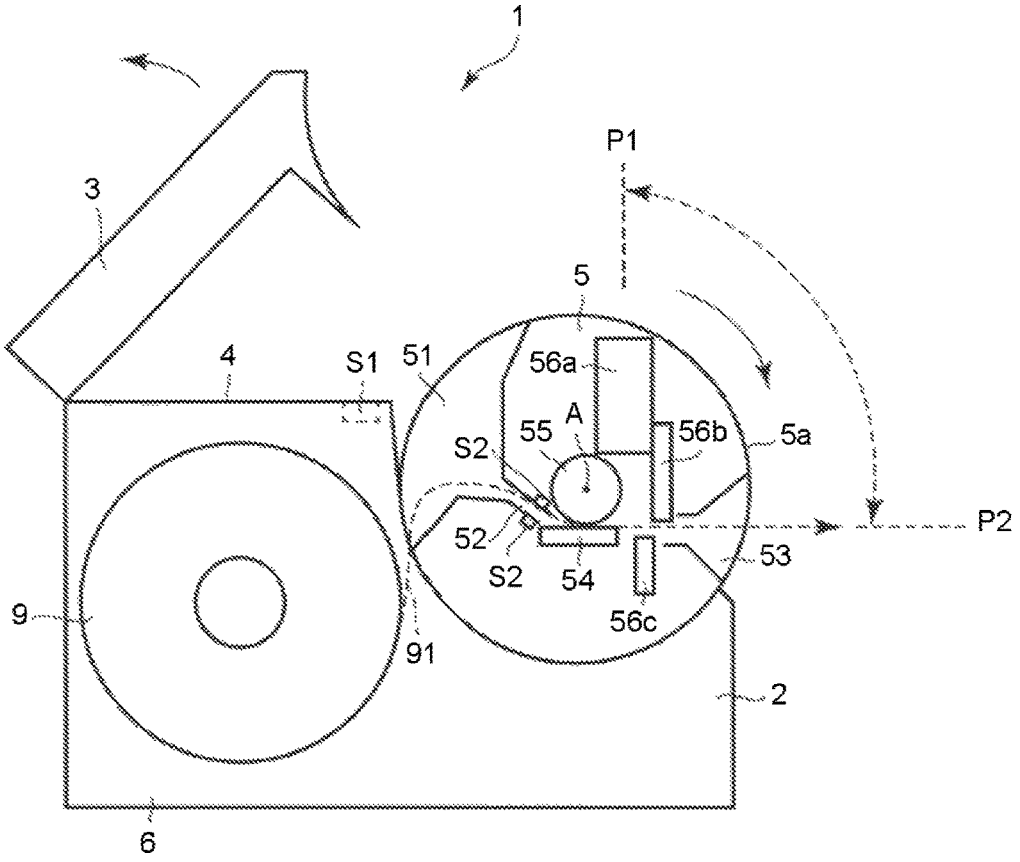
FIG. 3 is a sectional view exemplifying schematic configurations of the printer according to the embodiment and is a diagram illustrating an example of a state (roll paper loadable state) in which a cover is opened and an opening is opened.

FIG. 1 is a sectional view exemplifying schematic configurations of the printer according to the embodiment from a lateral side and is a diagram illustrating an example of a printer section 5 of which a discharge section 53 stops at a first position (for example, vertical direction discharge position (0 degree)). FIG. 2 is a sectional view exemplifying schematic configurations of the printer according to the embodiment from the lateral side and is a diagram illustrating an example of the printer section 5 of which the discharge section 53 stops at a second position (for example, horizontal direction discharge position (90 degrees)). FIG. 3 is a sectional view exemplifying schematic configurations of the printer according to the embodiment and is a diagram illustrating an example of a state (loadable state of a roll paper 9) in which a cover 3 is opened and an opening 4 is opened.

For example, the printer shown in FIG. 1, FIG. 2, and FIG. 3 is a POS printer constituting a part of a POS (Point Of Sales) system which is widespread in a store for supplying various commodities and services. As shown in FIG. 1, FIG. 2 and FIG. 3, a printer 1 comprises a housing 2, the cover (lid) 3, and the printer section 5. The housing 2 includes the opening 4. The cover 3 is openable with respect to the housing 2. As shown in FIG. 1 and FIG. 2, if the cover 3 is closed with respect to the housing 2, the opening 4 is sealed by the cover 3. As shown in FIG. 3, if the cover 3 is opened with respect to the housing 2, the opening 4 is opened, and it is possible to load the roll paper (image receiving medium roll) 9 into the housing section 6. A sensor S1 detects opening and closing (opened state of the cover 3 or closed state of the cover 3) of the cover 3. In other words, the sensor S1 detects opening (state) and closing (state) of the opening 4. For example, the printer 1 is a thermal printer, and the roll paper 9 is a thermal paper. Furthermore, in the present embodiment, a case in which the printer 1 is the thermal printer is described; however, the printer 1 may be an inkjet printer, a laser printer or other types of printers.

The printer section 5, for example, is rotatable around a rotating shaft A. For example, the printer section 5 is a cylindrical shape, and includes an outer peripheral surface 5*a* which rotates around the rotating shaft A. The printer section 5 is rotatable in a rotation range of 90 degrees from a state in which the discharge section 53 stops at the first position to a state in which the discharge section 53 stops at the second position. Furthermore, the rotation range of the printer section 5 may be greater than or less than 90 degrees. The printer section 5 can stop at an optional rotation position. The rotation of the printer section 5 may be manual or automatic (motor rotation). In the present embodiment, a case in which the printer section 5 of the printer 1 is rotated through a motor is mainly described.

The printer section 5 comprises a receiving port 51, a conveyance path 52, the discharge section 53, a print head 54, a platen 55, a cutting motor 56*a*, a movable cutter 56*b*, a fixed cutter 56*c* and a sensor S2. For example, the receiving port 51, the conveyance path 52, the discharge section 53, the print head 54, the cutting motor 56*a*, the movable cutter 56*b*, the fixed cutter 56*c* and the sensor S2 are fixed with respect to the printer section 5. If the printer section 5 is rotated, theses sections rotate integrally with the printer section 5.

The receiving port 51 receives a sheet 91 (image receiving medium) drawn out from the roll paper 9. The sensor S2 detects a front end of the sheet 91 received by the receiving port 51. The front end of the sheet 91 received by the receiving port 51 passes through a space between the print head 54 and the platen 55 via the conveyance path 52. The platen 55 rotates around the rotating shaft A independently of the rotation of the printer section 5. The sheet 91 is drawn in through the rotation of the platen 55, and information is printed (thermally printed) by the print head 54 on the drawn sheet 91. After that, the sheet is discharged from the discharge section 53.

As described above, the discharge section 53 is rotated integrally with the printer section 5. For example, if the printer section 5 is rotated and the discharge section 53 (from the discharge section 53) is set to a first position P1, the sheet 91 is discharged from the discharge section 53 set to (positioned at) the first position P1 to a first direction (upper part direction). If the printer section 5 is rotated and the discharge section 53 is set to a second position P2, the sheet 91 is discharged from the discharge section 53 set to (positioned at) the second position P2 to a second direction (front part direction). In other words, the sheet 91 can be discharged to an optional direction in response to a stop position (rotation angle) of the printer section 5.

In this way, for example, in a case of placing the printer 1 on the desk, the discharge section 53 is set to an optional position, and the sheet 91 can be discharged to an optional direction. In a case of placing the printer 1 under the desk or the like, the discharge section 53 is set to the second position P2, and the sheet 91 can be discharged to a horizontal direction. In other words, the printer 1 has a high degree of freedom of the discharge position (discharge direction) of a printed matter.

Figure 4:
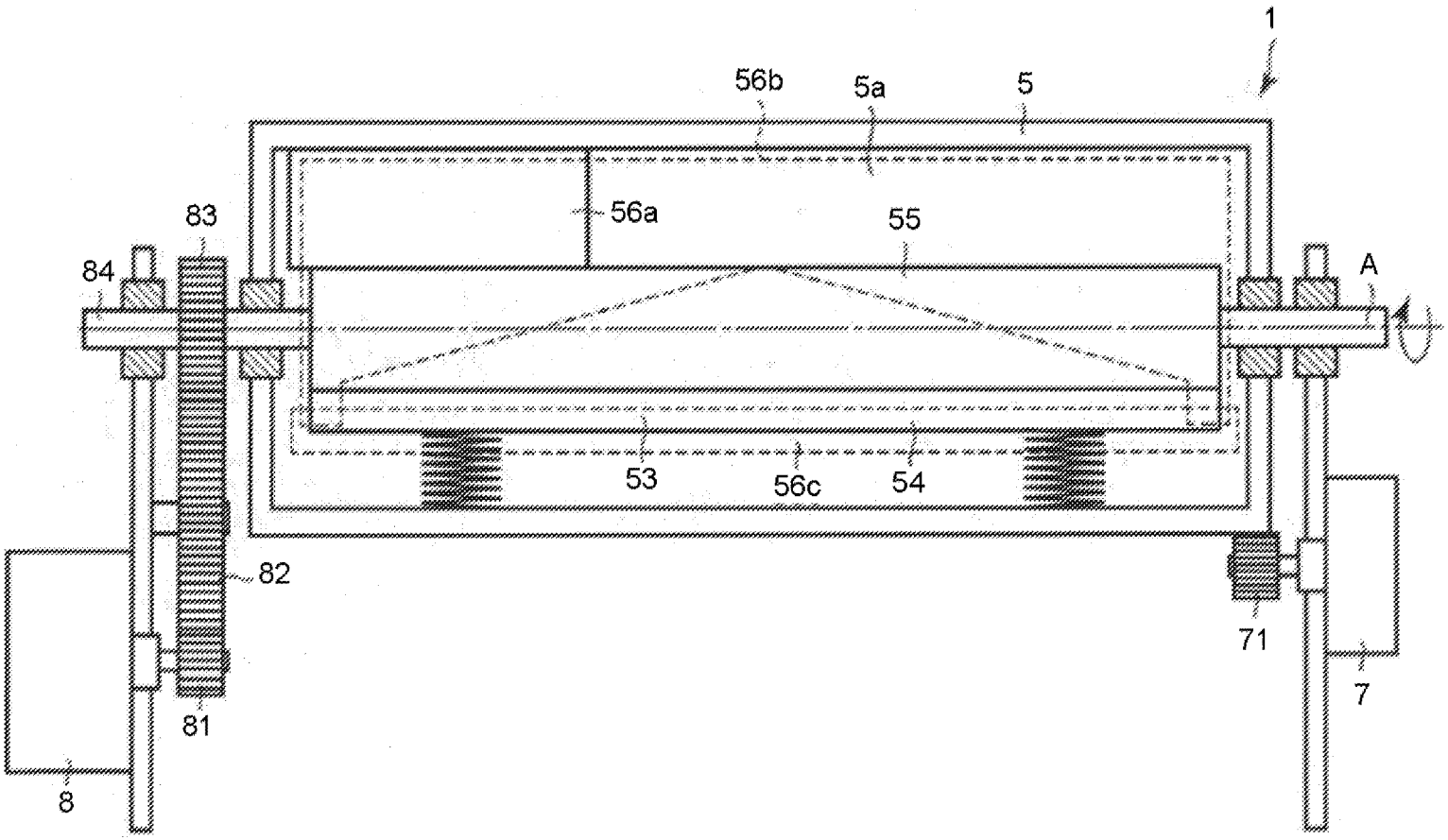
FIG. 4 is a sectional view exemplifying schematic configurations of a printer section and a platen of the printer according to the embodiment from a front side.

Next, with reference to FIG. 4, the rotation of the printer section and the rotation of the platen of the printer according to the embodiment are described. FIG. 4 is a sectional view exemplifying schematic configurations of the printer section and the platen of the printer according to the embodiment from a front side. As shown in FIG. 4, the printer 1 includes a rotation motor 7 and a gear 71. For example, the rotation motor 7 is a stepping motor, and torque of the rotation motor 7 is transmitted to the printer section 5 via the gear 71, in this way, the printer section 5 is rotated. The printer 1 comprises a feed motor 8, gears 81, 82 and 83 and a shaft 84. For example, the feed motor 8 is a stepping motor, and the torque of the feed motor 8 is transmitted to the platen 55 via the gears 81, 82 and 83 and the shaft 84, in this way, the platen 55 is rotated. Furthermore, in the present embodiment, a case in which the gears 71, 81, 82 and 83 are applied is described; however, it is not limited to that. For example, instead of each gear, a combination of a pulley and a belt may be applicable.

For example, the printer section 5 and the platen 55 are concentric, and the printer section 5 and the platen 55 rotates around the rotating shaft A. Further, the rotation of the printer section 5 and the rotation of the platen 55 are mutually independent.

Figure 5:
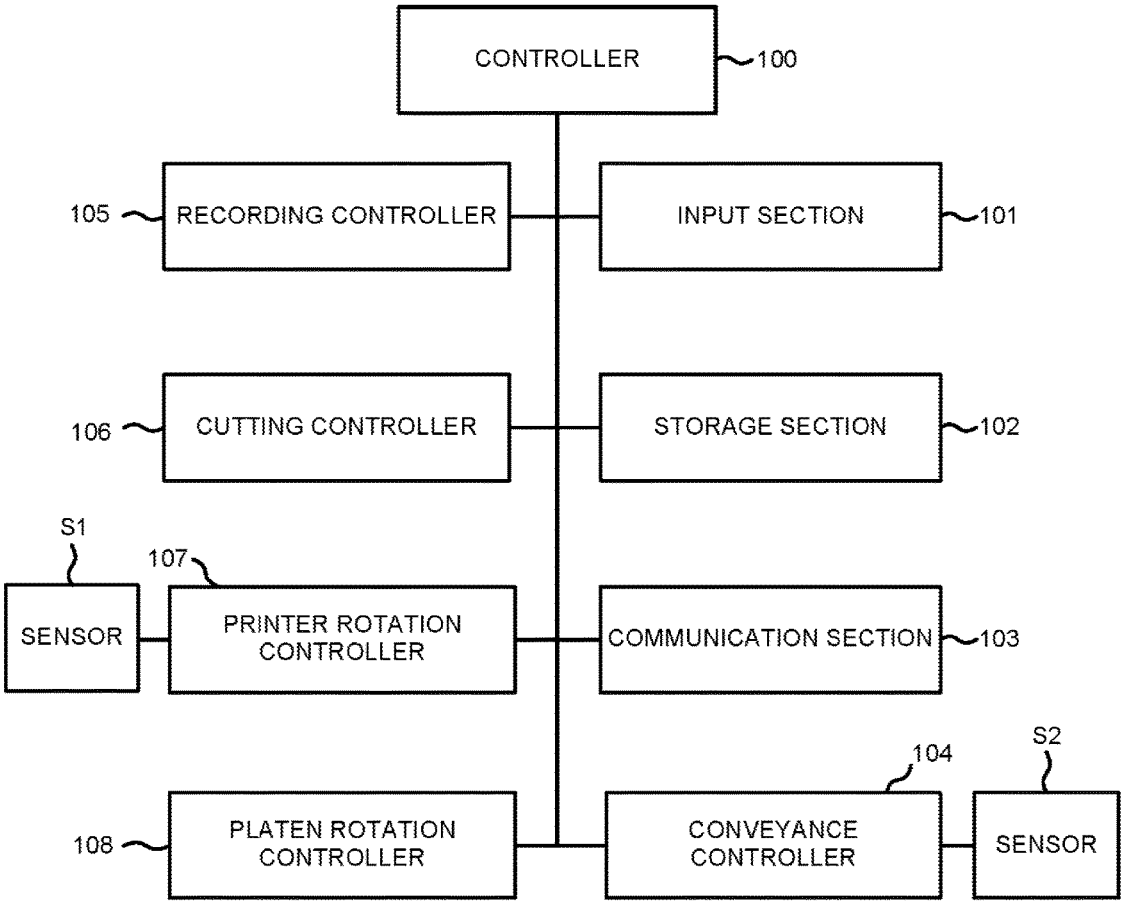
FIG. 5 is a diagram illustrating an example of functional blocks of the printer according to the embodiment.

FIG. 5 is a diagram illustrating an example of functional blocks of the printer according to the embodiment. As shown in FIG. 5, the printer 1 comprises a controller 100, an input section (designation section) 101, a storage section 102, a communication section 103, a conveyance controller 104, a recording controller 105, a cutting controller 106, a printer rotation controller 107 and a platen rotation controller 108.

The controller 100 controls all or a portion of the print operations. The input section 101 receives an input operation by an operator, and inputs various instructions (printer rotation instruction and the like) to the printer 1. The storage section 102 stores various operation control programs or print data. The communication section 103 communicates with an external device to receive various operation control programs or the print data. The conveyance controller 14 executes autoloading based on a detection signal from the sensor S2. In other words, the conveyance controller 14 draws the sheet 91 loaded to the receiving port 51 and feeds the sheet 91 into the space between the print head 54 and the platen 55 based on the detection signal from the sensor S2. The print head 54 prints the information on the fed sheet 91. Further, the conveyance controller 14 discharges the sheet 91 on which the information is printed from the discharge section 53.

The recording controller 105 controls the print head 54 based on the print data to print the information on the sheet 91 based on the print data. The cutting controller 106 enables the cutting motor 56*a* to operate at a predetermined timing to cut the sheet 91 through the movable cutter 56*b* and the fixed cutter 56*c*.

The printer rotation controller 107 controls the rotation of the printer section 5 based on a printer rotation instruction (designation of the discharge position of the sheet) from the input section 101 or a signal from the sensor S1. For example, the printer rotation controller 107 outputs a pulse to the rotation motor 7 to rotate (normally rotate or reversely rotate) the printer section 5 by a predetermined angle through the rotation motor 7. The platen rotation controller 108 controls the rotation of the platen 55 based on a signal from the sensor S2 (autoloading). For example, the platen rotation controller 108 outputs a pulse to the feed motor 8 to rotate the platen by a predetermined angle through the feed motor 8.

Figure 6:
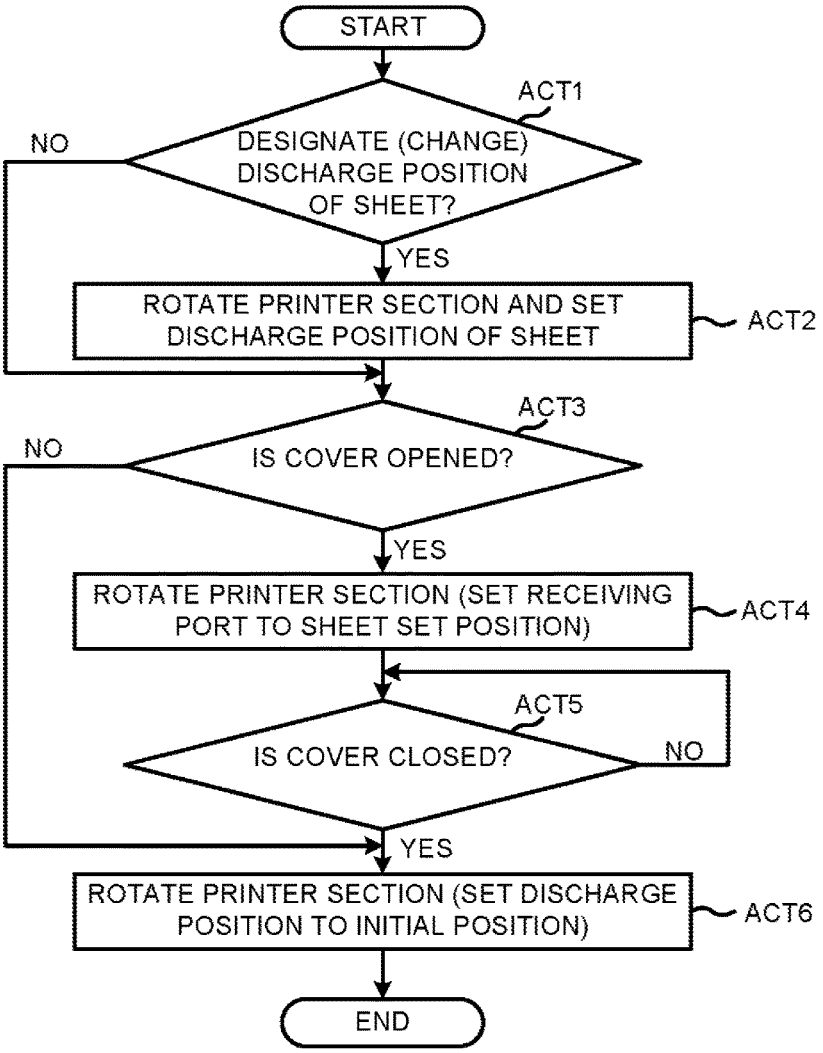
FIG. 6 is a flowchart illustrating an example of a rotation control of the printer section of the printer according to the embodiment.

FIG. 6 is a flowchart illustrating an example of a rotation control of the printer section of the printer according to the embodiment.

Figure 7:
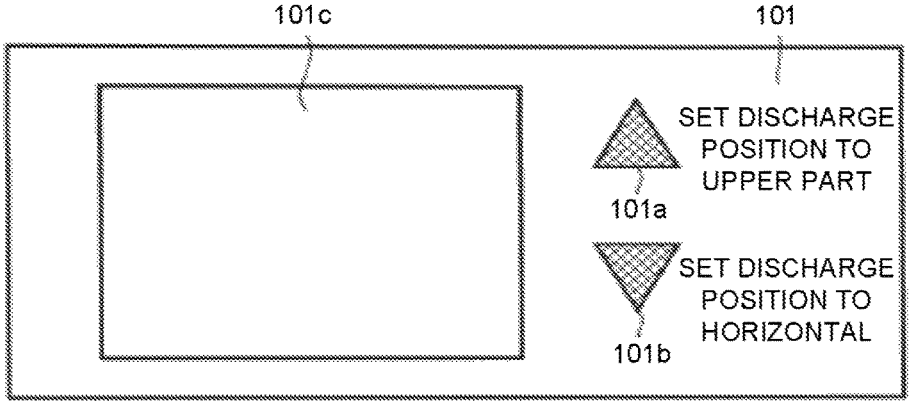
FIG. 7 is a diagram illustrating an example of an input section of the printer section according to the embodiment.

For example, the user can designate the discharge position (discharge direction) of the sheet via the input section 101. For example, as shown in FIG. 7, the input section 101 includes a first button 101*a*, a second button 101*b* and a display section 101*c*. The user can press the first button 101*a* long to designate (set) the discharge section 53 to the first position P1. In response to long pressing on the first button 101*a* (YES in ACT 1), the input section 101 notifies the printer rotation controller 107 of the rotation instruction for setting the discharge section 53 to the first position P1. The printer rotation controller 107 controls the rotation of the rotation motor 7 to rotate the printer section 5 by a predetermined angle to set the discharge section 53 to the first position P1 (ACT 2). Furthermore, in a case in which the discharge section 53 is already set to the first position P1, the rotation control of the printer section 5 is not executed. The display section 101*c* displays guidance such as "change the discharge position to vertical direction" in accordance with the long pressing on the first button 101*a*.

Similarly, the user can press the second button 101*b* long to designate (set) the discharge section 53 to the second position P2. In response to the long pressing on the second button 101*b* (YES in ACT 1), the input section 101 notifies the printer rotation controller 107 of the rotation instruction for setting the discharge section 53 to the second position P2. The printer rotation controller 107 controls the rotation of the rotation motor 7 to rotate the printer section 5 by a predetermined angle to set the discharge section 53 to the second position P2 (ACT 2). Further, in a case in which the discharge section 53 is already set to the second position P2, the rotation control of the printer section 5 is not executed. The display section 101*c* displays guidance such as "change the discharge position to horizontal direction" according to the long pressing on the second button 101*b*.

Further, according to the length of pressing time of the first button 101*a*, the printer section 5 can be rotated in a direction from the second position P2 to the first position P1. Similarly, according to the length of pressing time of the second button 101*b*, the printer section 5 can be rotated in a direction from the first position P1 to the second position P2. In this way, according to the length of pressing time of the first button 101*a* or the second button 101*b*, the discharge section 53 can be set to an optional position.

At the time of exchanging the roll paper 9, the cover 3 is opened. If the cover 3 is opened, the sensor S1 detects the opening of the cover 3 and outputs a detection signal (YES in ACT 3). The detection signal from the sensor S1 is notified to the printer rotation controller 107. The printer rotation controller 107 controls the rotation of the rotation motor 7 to rotate the printer section 5 by a predetermined angle, and changes the discharge section 53 rotating integrally with the printer section 5 from a current position (predetermined position) to the second position P2. In other words, the receiving port 51 rotating integrally with the printer section 5 is set to a sheet set position (medium receiving position) (ACT 4). Further, in a case in which the discharge section 53 is already set to the first position P1 (in other words, a case in which the receiving port 51 is set to the sheet set position), the rotation control of the printer section 5 is not executed.

If the exchange of the roll paper 9 is completed and the cover 3 is closed, the sensor S1 detects the closing of the cover 3 and outputs a detection signal (YES in ACT 5). The detection signal from the sensor S1 is sent to the printer rotation controller 107. The printer rotation controller 107 controls the rotation of the rotation motor 7 to rotate the printer section 5 by a predetermined angle and changes the discharge section 53 rotating integrally with the printer section 5 from the second position P2 to an initial position (predetermined position).

In this way, the printer 1 of the present embodiment can discharge the sheet from an optional position. At the time of exchanging work of the roll paper 9, as the receiving port 51 is set to the sheet set position, the exchanging work of the roll paper 9 can be smoothly executed. Further, after the exchanging work of the roll paper 9 is completed, as the discharge position from the discharge section 53 is returned to the initial discharge position, time and labor spent in resetting the discharge position can be saved.

Figure 8:
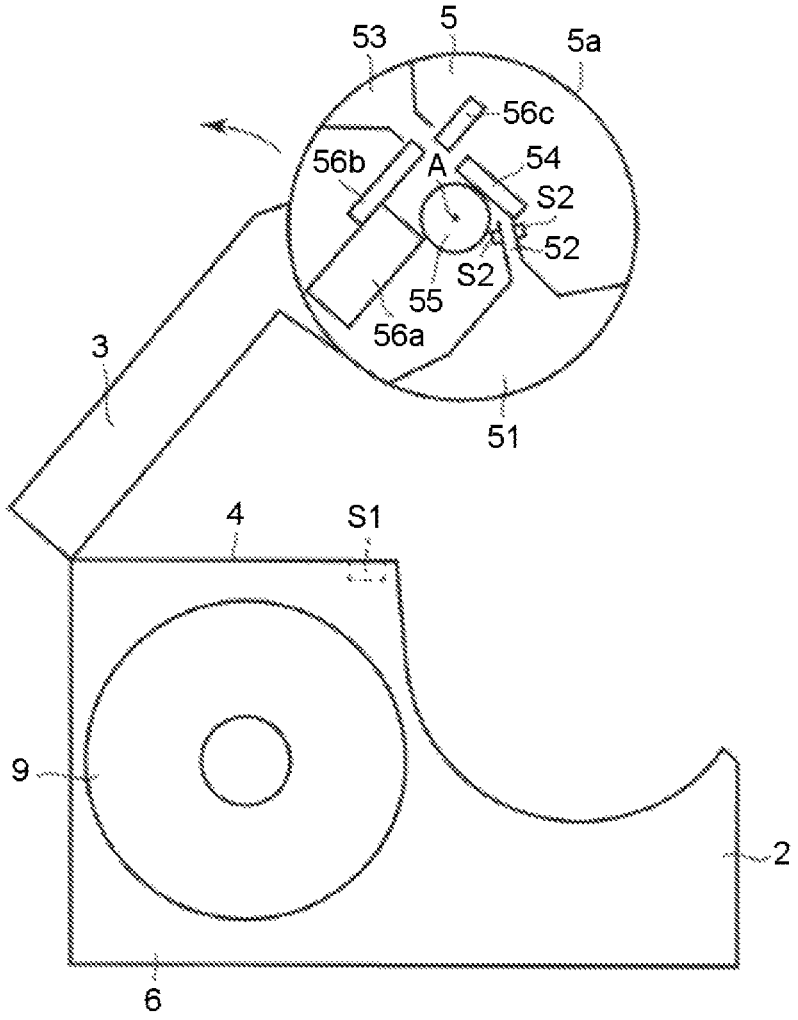
FIG. 8 is a sectional view exemplifying schematic configurations of a printer according to an embodiment and is a diagram illustrating an example in which a printer section and a cover are integrally opened and closed.

FIG. 8 is a sectional view exemplifying schematic configurations of a printer according to an embodiment and is a diagram illustrating an example in which the printer section 5 and the cover 3 are integrally opened and closed. As shown in FIG. 8, through enabling the printer section 5 and the cover 3 to be integrally openable, the loading work of the roll paper 9 becomes easier. The rotation control of the printer section 5 for the loading work of the roll paper 9 is unnecessary.

Further, in the present embodiment, a case in which the printer section 5 of the printer 1 is rotated (automatically rotated) through the motor is mainly described; however, the printer section 5 may be manually rotated. In that case, for example, at the time of setting the discharge section 53 to the second position P2, the cover 3 may be opened and the smooth loading work of the roll paper 9 may be supported. For example, a protrusion is arranged by removing a part of the printer section 5 along the outer periphery surface, and thus, if the cover 3 is attempted to be opened, the front end of the cover 3 abuts against the protrusion and the cover 3 is not opened. However, at the time of setting the discharge section 53 to the second position P2, the part where there is no protrusion on the outer periphery surface of the printer section 5 faces the front end of the cover 3, and the cover 3 is opened.

All the procedures of the rotation control can be executed by software. Therefore, only by executing a program for executing the procedures of the control installed in the printer 1 through a computer-readable storage medium storing the program, it is possible to easily realize the foregoing control in the printer 1.

For example, through the communication section 103, it is possible to read the program from a computer-readable storage medium, store a program read into the storage section 102, and complete the installation of the program. Alternatively, through the communication section 103, it is possible to download the program, store the program downloaded into the storage section 102 and complete the installation of the program. Thus, the controller 100 of the printer 1 can easily realize the control based on the installed program.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a housing section configured to house a roll-like image receiving medium; and a printer section configured to rotate around a rotating shaft independent of a platen and comprising a print head configured to print information on the image receiving medium fed from the housing section, the platen arranged opposite to the print head configured to rotate around a rotating shaft and a discharge section configured to discharge the image receiving medium passing through a space between the print head and the platen, wherein the printer section has a cylindrical shape.

2. The printer according to claim 1, wherein the printer section has an outer periphery surface which rotates with respect to the rotating shaft, and the discharge section discharges the image receiving medium from a part of the outer periphery surface.

3. The printer according to claim 1, further comprising a housing comprising an opening configured to receive an image receiving medium roll and the printer section; and a lid configured to be openable with respect to the opening, wherein the printer section comprises a receiving port configured to receive the image receiving medium drawn out from the image receiving medium roll.

4. The printer according to claim 3, further comprising a detection section configured to detect opening and closing of the lid; and a rotation section configured to rotate the printer section, wherein the rotation section rotates the printer section according to detection of opening of the lid and sets the receiving port to a medium receiving position.

5. The printer according to claim 4, further comprising a designation section configured to designate the discharge section to a predetermined position, wherein the rotation section rotates the printer section according to the designation and sets the discharge section rotating integrally with the printer section to the predetermined position, and the rotation section further rotates the printer section according to detection of the opening of the lid and sets the receiving port rotating integrally with the printer section to a medium receiving medium, and rotates the printer section according to detection of closing of the lid and sets the discharge section rotating integrally with the printer section to the predetermined position.

6. The printer according to claim 1, the printer section further comprising a cutting motor and cutter that rotate around the rotating shaft.

7. The printer according to claim 1, wherein the printer is one of a thermal printer, an inkjet printer, or a laser printer.

8. A printing method, comprising:

rotating a printer section around a rotating shaft independent of a platen, the printer section comprising a print head, wherein the rotating the printer section comprises detecting opening and closing of a lid and rotating the printer section according to detection of opening of the lid;

printing information on a roll-like image receiving medium;

rotating the platen around a rotating shaft, the platen arranged opposite to the print head; and discharging the image receiving medium passing through a space between the print head and the platen.

9. The printing method according to claim 8, wherein the printer section has an outer periphery surface which rotates with respect to the rotating shaft, and the image receiving medium being discharged from a part of the outer periphery surface.

10. The printing method according to claim 8, further comprising receiving the image receiving medium drawn out from the image receiving medium roll.

11. The printing method according to claim 8, further comprising designating a predetermined position discharging the image receiving medium, wherein rotating the printer section according to the designating sets the discharging rotating integrally with the printer section to the predetermined position, and rotating the printer section upon detecting the opening of the lid, and rotating the printer section upon detecting closing of the lid.

12. The printing method according to claim 8, further comprising rotating a cutting motor and cutter around the rotating shaft.

13. The printing method according to claim 8, wherein printing is one of thermal printing, inkjet printing, or laser printing.

14. A printer, comprising:

a housing section configured to house a roll-like image receiving medium;

a printer section configured to rotate around a rotating shaft independent of a platen and comprising a print head configured to print information on the image receiving medium fed from the housing section, the platen arranged opposite to the print head configured to rotate around a rotating shaft and a discharge section configured to discharge the image receiving medium passing through a space between the print head and the platen, wherein the printer section further comprises a cutting motor and a cutter that rotate around the rotating shaft; and a controller configured to control at least a portion of print operations.

15. The printer according to claim 14, wherein the printer section has an outer periphery surface which rotates with respect to the rotating shaft, and the discharge section discharges the image receiving medium from a part of the outer periphery surface.

16. The printer according to claim 14, further comprising a housing comprising an opening configured to receive an image receiving medium roll and the printer section; and a lid configured to be openable with respect to the opening, wherein the printer section comprises a receiving port configured to receive the image receiving medium drawn out from the image receiving medium roll.

17. The printer according to claim 16, further comprising a detection section configured to detect opening and closing of the lid; and a rotation section configured to rotate the printer section, wherein the rotation section rotates the printer section according to detection of opening of the lid and sets the receiving port to a medium receiving position.

18. The printer according to claim 17, further comprising a designation section configured to designate the discharge section to a predetermined position, wherein the rotation section rotates the printer section according to the designation and sets the discharge section rotating integrally with the printer section to the predetermined position, and the rotation section further rotates the printer section according to detection of the opening of the lid and sets the receiving port rotating integrally with the printer section to a medium receiving medium, and rotates the printer section according to detection of closing of the lid and sets the discharge section rotating integrally with the printer section to the predetermined position.

* * * * *